United States Patent [19]

McMath et al.

[11] 4,196,759

[45] Apr. 8, 1980

[54] LIQUID DISPENSING NOZZLE HAVING A SEALING ARRANGEMENT FOR VAPOR RECOVERY

[75] Inventors: Jack A. McMath, Fort Thomas, Ky.; Robert W. Guertin, Cincinnati; Chester W. Wood, Milford, both of Ohio

[73] Assignee: Dover Corporation, New York, N.Y.

[21] Appl. No.: 858,451

[22] Filed: Dec. 8, 1977

Related U.S. Application Data

[63] Continuation of Ser. No. 696,936, Jun. 17, 1976, abandoned.

[51] Int. Cl.[2] ..... B65B 3/18

[52] U.S. Cl. ..... 141/98; 141/311 R; 141/392; 141/DIG. 1

[58] Field of Search ..... 141/52, 59, 93, 97, 141/128, 198, 206-229, 285, 290, 311 R, 382-386, 397, 98, DIG. 1; 277/9

[56] References Cited

U.S. PATENT DOCUMENTS

| | | | |
|---|---|---|---|
| 3,974,865 | 8/1976 | Fenton | 141/311 R |
| 4,008,738 | 2/1977 | Moskovick | 141/311 R |

*Primary Examiner*—Frederick R. Schmidt
*Attorney, Agent, or Firm*—John G. Schenk

[57] ABSTRACT

A liquid dispensing nozzle has an annular member of a relatively soft material at one end of a bellows, which is disposed in spaced relation to the spout of the nozzle to form an annular vapor return passage therebetween, to engage the fill pipe to form a seal therewith when the spout is disposed therein so that the vapors flow from the tank to the annular vapor return pasage of the nozzle. The soft seal member is removably fastened to the end of the bellows for easy replacement. The spout has a pair of latch rings thereon spaced from each other with each having a retaining lug to enable the spout to be retained within any type of fill pipe since one of the lugs on one of the latch rings is always capable of being retained by the lip of the fill pipe opening.

27 Claims, 19 Drawing Figures

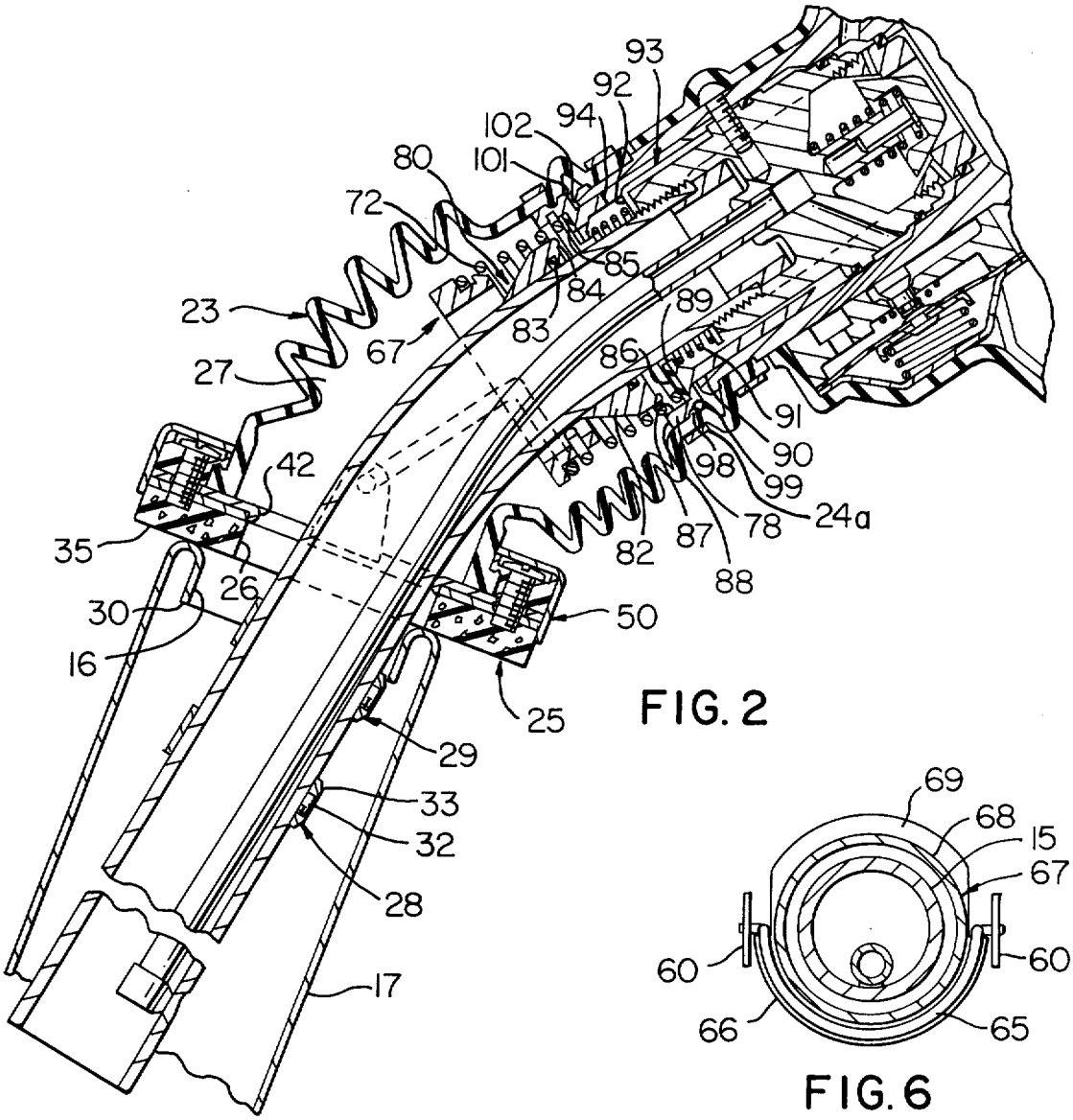
FIG. 2
FIG. 6
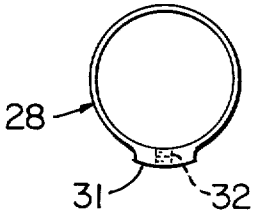
FIG. 8
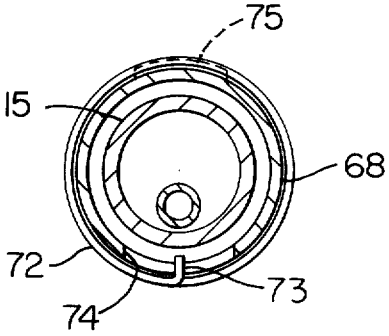
FIG. 7

LIQUID DISPENSING NOZZLE HAVING A SEALING ARRANGEMENT FOR VAPOR RECOVERY

This is a continuation of application Ser. No. 696,936, filed June 17, 1976 and now abandoned.

When filling a vehicle tank with gasoline through a dispensing nozzle, vapors from the gasoline within the tank escape therefrom through the opening of the fill pipe in which the spout of the nozzle is inserted. This escape of the vapors into the atmosphere pollutes the air.

It has previously been suggested to provide a gasoline dispensing nozzle with a vapor return passage and a sealing arrangement between the fill pipe of the tank being filled and the vapor return passage of the nozzle. Because of the large number of different types of vehicles and the various angles of the fill pipes due to the location of the fill pipe in each of the vehicles, the previously suggested sealing arrangements have not always been effective for all types of fill pipe.

The present invention is an improvement of the previously suggested sealing arrangement in that it enables a seal to be maintained between the fill pipe and the vapor return passage of the nozzle for any type of fill pipe irrespective of its angle. The present invention accomplishes this by utilizing a sealing member of a relatively soft material. Thus, the sealing member has sufficient compressibility to enable it to always engage the fill pipe opening irrespective of the angle of the fill pipe into which the spout is inserted.

Because of the sealing member being relatively soft so as to be compressible when engaging the fill pipe, it will tend to wear quicker than a seal of relatively hard rubber such as utilized in U.S. Pat. No. 3,866,636 to Lasater, for example. Therefore, it is necessary to be able to replace the soft sealing member of the present invention easily and quickly without affecting the remainder of the vapor recovery arrangement.

The present invention accomplishes this through removably fastening the soft sealing member to the end of the bellows so that there is exposure of only the removable fastening means, which hold the soft sealing member at the end of the bellows, such as screws, for example. Thus, the service station attendant will not normally attempt to remove any other parts since these are the only visible screws. Therefore, the present invention provides an easy means for replacement of the soft sealing member when necessary without the user attempting to further disassemble the vapor recovery arrangement either inadvertently or intentionally.

Because of the various angles of fill pipes for vehicle tanks, it has sometimes been difficult, if not impossible, to hook the spout within the fill pipe when utilizing a vapor recovery seal. The present invention employs a pair of selectively spaced latch rings on the spout to selectively use a retaining lug on one of the latch rings to retain the spout within the fill pipe so that the attendant may perform other functions while the tank is being automatically filled.

The retaining lugs are formed so that they utilize a minimum amount of space in the vapor return passage, which is formed between the spout and the bellows while still retaining the spout within the fill pipe. Additionally, each of the lugs is effective so that any rotation of the spout relative to the bellows when the spout is inserted in the fill pipe opening does not cause any release of the retaining lug from the lip of the fill pipe opening when the nozzle is released after being locked therein.

When inserting a spout within a fill pipe with the nozzle having a vapor recovery seal engaging the end of the fill pipe, the spout may rotate to some degree after being inserted within the fill pipe opening and locked within the fill pipe because the attendant cannot see the angle at which he has inserted the spout within the fill pipe because of the presence of the vapor return seal around the fill pipe. This can result in the angle of the spout being changed and/or the spout rotating relative to the fill pipe after release of the spout by the attendant. This can cause the vapor recovery seal, which has been firmly seated against the fill pipe, to be moved or dragged to possibly cause the seal to be ineffective.

The present invention satisfactorily overcomes this problem through providing an arrangement in which the spout can rotate within the fill pipe without causing any movement of the vapor recovery seal, which has been firmly seated against the fill pipe. This eliminates any possibility of the seal being damaged or not being effective.

The present invention accomplishes this through allowing relative rotary movement between the spout, which has one end of the spring urging the seal to its sealing position connected thereto, and the seal, which has the other end of the spring exerting a force thereon. The present invention produces this relative rotary motion through enabling the spring to move relative to a retainer, which is pivotally connected to the support structure for the seal.

An object of the invention is to provide a relatively soft vapor recovery seal for a liquid dispensing nozzle.

Another object of this invention is to provide a liquid dispensing nozzle capable of being locked within any fill pipe while still having a vapor recovery seal with the fill pipe opening.

A further object of this invention is to provide a liquid dispensing nozzle having a spout capable of being locked within a fill pipe at more than one position.

Still another object of this invention is to provide a vapor recovery seal for a liquid dispensing nozzle in which there can be relative rotation between the spout and the vapor recovery seal after the vapor recovery seal is in sealing engagement with the fill pipe.

Other objects, uses, and advantages of this invention are apparent upon a reading of this description, which proceeds with reference to the drawings forming part thereof and wherein:

FIG. 2 is a fragmentary sectional view, partly in elevation, of the nozzle of FIG. 1 with the spout of the nozzle disposed in the fill pipe of a vehicle tank to be filled and the seal being effective.

FIG. 6 is a cross sectional view of the nozzle taken along line 6—6 of FIG. 1 and showing the connection of the spring retainer to the end of the bellows.

FIG. 7 is a cross sectional view of the nozzle of FIG. 1 taken along line 7—7 of FIG. 1 and showing the connection of one end of the spring to the spring retainer.

FIG. 8 is a plan view of one of the latch rings for retaining the spout of the nozzle within the fill pipe.

Figure 1:
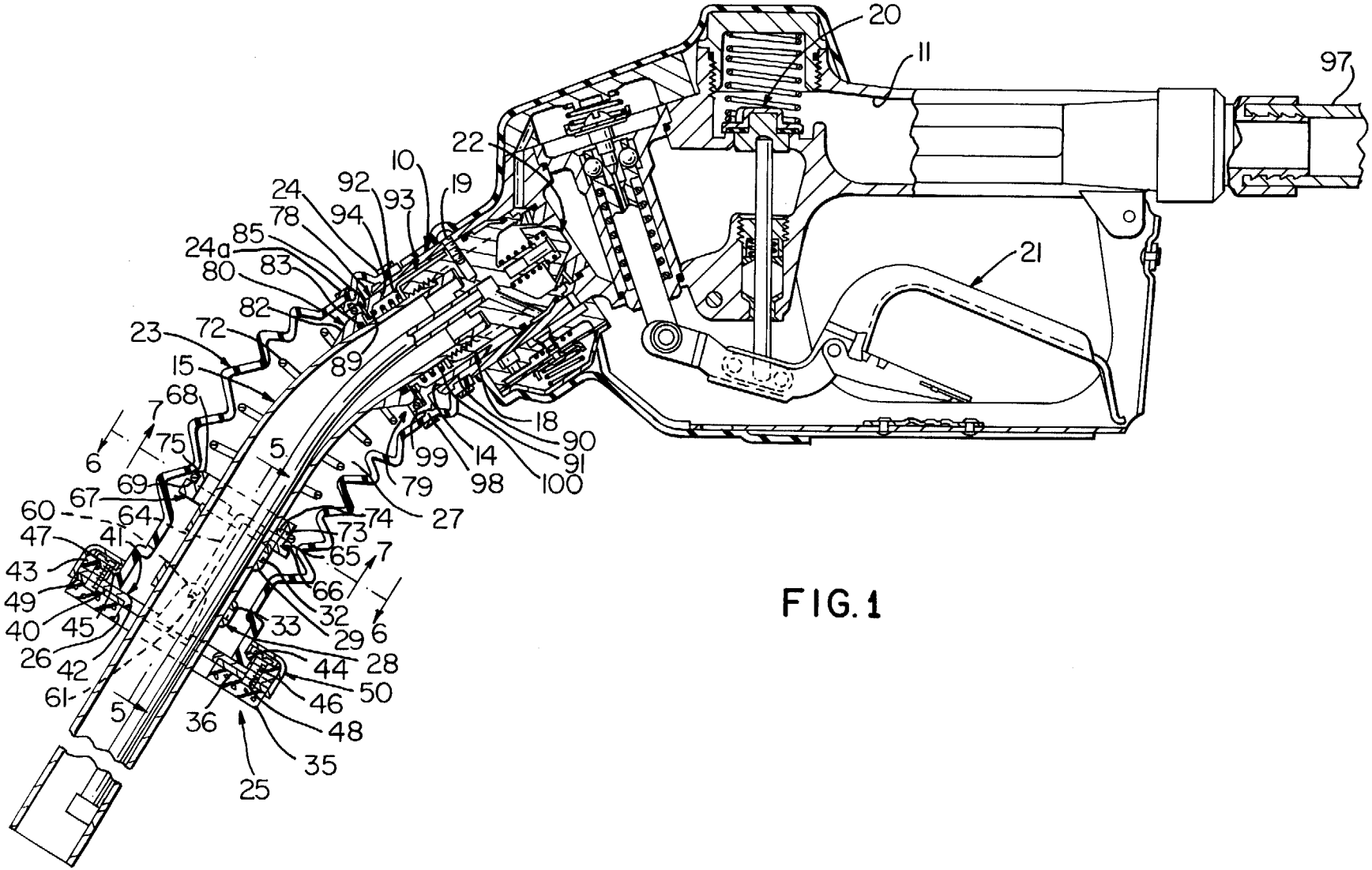
FIG. 1 is a sectional view, partly in elevation, of a liquid dispensing nozzle having the relatively soft seal of the present invention.

Referring to the drawings and particularly FIG. 1, there is shown a liquid dispensing nozzle including a nozzle body 10. The nozzle body 10 has an inlet 11 to which a hose is connected to supply liquid such as gasoline, for example, to the interior of the body 10. The body 10 has an outlet 14 with which a spout 15 communicates to receive a liquid from the interior of the body 10.

The spout 15, which is adapted to be inserted within an opening 16 (see FIG. 2) in a fill pipe 17 of a vehicle tank such as an automobile fuel tank, for example, has an end threaded in a spout adapter 18, which is connected to the outlet 14 of the body 10 by a screw 19. The screw 19 is preferably formed of a material that will break or shear when subjected to a predetermined force. Thus, if the spout 15 should be retained in a vehicle tank when the vehicle is moved, the screw 19 breaks and allows the spout adapter 18 to be pulled from the body 10 without any damage to the body 10 or to the pump to which the body 10 is connected by the inlet hose.

The body 10 has a first or main poppet valve 20, which is controlled by a manually operated lever or handle 21, and a second poppet valve 22 therein. The valves 20 and 22 control the flow to the spout 15 in the manner more particularly shown and described in U.S. Pat. No. 3,823,752 to Lasater et al.

The outlet 14 of the body 10 has one end of a bellows 23, which is preferably formed of a gasoline resistant synthetic rubber, for example, secured thereto by being held thereon by a clamp 24. The outer end of the bellows 23 has a relatively soft sealing means 25 removably fastened thereto. The relatively soft sealing means 25 has an enlarged opening 26 formed in the center thereof to enable the relatively soft sealing means 25 to slide along the spout 15.

When the spout 15 is inserted in the fill pipe opening 16 as shown in FIG. 2, the relatively soft sealing means 25 engages the end of the fill pipe 17 to form a seal therewith through being compressible. Thus, any vapor within the tank being filled can flow from the tank through the fill pipe opening 16 and the opening 26 in the relatively soft sealing means 25 into an annular passage 27, which is formed between the bellows 23 and the spout 15.

The spout 15 has two latch rings 28 and 29 formed thereon for engagement with a lip 30 of the fill pipe 17 to hold the free end of the spout 15 within the fill pipe 17. Thus, the spout 15 can be held in two different positions within the fill pipe 17.

Each of the latch rings 28 and 29, which are identical, is selectively positioned along the length of the spout 15. As shown in FIG. 8, the latch ring 28 has an eccentric retaining lug 31. It is necessary for the retaining lug 31 of each of the latch rings 28 and 29 to be positioned on the bottom of the spout 15. The retaining lug 31 has a threaded passage to receive a set screw 32 (see FIG. 1) to retain each of the latch rings 28 and 29 on the spout 15 in the desired spaced relation to each other.

As shown in FIG. 1, the retaining lug 31 of each of the latch rings 28 and 29 has an inclined surface or shoulder 33 formed at an angle to insure that the retaining lug 31 will not slip off the lip 30 of the fill pipe 17. The angle of the inclined surface or shoulder 33 must be selected so that the retaining lug 31 will not catch on the lip 30 of the fill pipe 17 to such an extent that it cannot be removed. The inclined surface or shoulder 33 preferably has an angle of 15° to the spout 15.

The retaining lug 31 of each of the latch rings 28 and 29 provides a minimum blockage to vapor flow through the fill pipe opening 16 as shown in FIG. 2 when the spout 15 is locked by the retaining lug 31 of the latch ring 29 engaging the lip 30 of the fill pipe 16.

If the retaining lug 31 of the latch ring 28 engages the lip 30, there is the additional advantage of the retaining lug 31 of the latch ring 29, which is disposed within the bellows 23, also blocking the annular passage 27 to a minimum.

As shown in FIG. 1, the relatively soft sealing means 25 includes a member 35, which is formed of a suitable compressible material such as soft rubber or foam rubber, for example, and a steel plate 36, which is bonded to the member 35 so as to be integral therewith. One suitable example of the compressible material of the member 35 is a synthetic foam rubber.

The thickness of the member 35 depends upon the material of which it is formed. The member 35 must have sufficient thickness so that it will be resilient enough to form a seal with the fill pipe 17 but not so thick as to be too soft and not form the seal with the fill pipe 17.

The support plate 36 abuts an annular base plate 40 of a retainer 41, which is formed of a rigid material. The retainer 41 can be formed of a suitable metal or plastic having the desired rigidity and is preferably formed of an acetal plastic such as Delrin, for example. The retainer 41 has a curved inner portion 42 overlapping the inner surface of the annular plate 36. The curved inner portion 42 is formed with a radius of curvature so that the retaining lug 31 of each of the latch rings 28 and 29 moves smoothly thereover during movement of the spout 15 with respect to the retainer 41 and the relatively soft sealing means 25.

A retaining ring 43, which is formed of a plastic, for example, is disposed adjacent the base plate 40 of the retainer 41 to retain an enlarged end 44 of the bellows 23 therebetween. The retaining ring 43 has a recess 45 formed therein to receive the enlarged end 44 of the bellows 23 with the enlarged end 44 being retained between the retaining ring 43 and the base plate 40 of the retainer 41.

Figure 4:
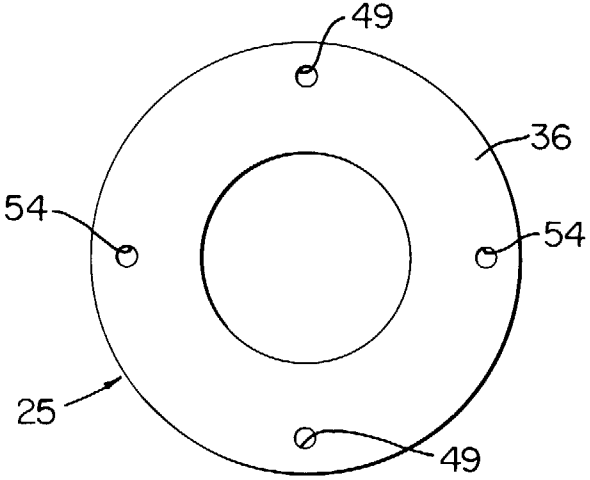
FIG. 4 is a plan view of the support plate of the present invention.

A pair of screws 46, which are diametrically disposed to each other, extends through holes 47 in the retaining ring 43 and into threaded holes 48 in the base plate 40 of the retainer 41 to secure the retainer 41 and the retaining ring 43 to each other. As shown in FIG. 4, the plate 36 has a pair of diametrically disposed holes 49, which are not threaded, to receive the ends of the screws 46.

The securing of the retainer 41 and the retaining ring 43 to each other squeezes the enlarged end 44 of the bellows 23 between the retaining ring 43 and the annular base plate 40 of the retainer 41. The recess 45 in the retaining ring 43 has a groove for cooperation with a portion of the enlarged end 44 of the bellows 23 to prevent pulling out of the enlarged end 44 of the bellows 23 from the recess 45 after the bellows 23 has been squeezed between the retaining ring 43 and the annular base plate 40 of the retainer 41 by the screws 46 securing the retainer 41 and the retaining ring 43 to each othere.

Figure 3:
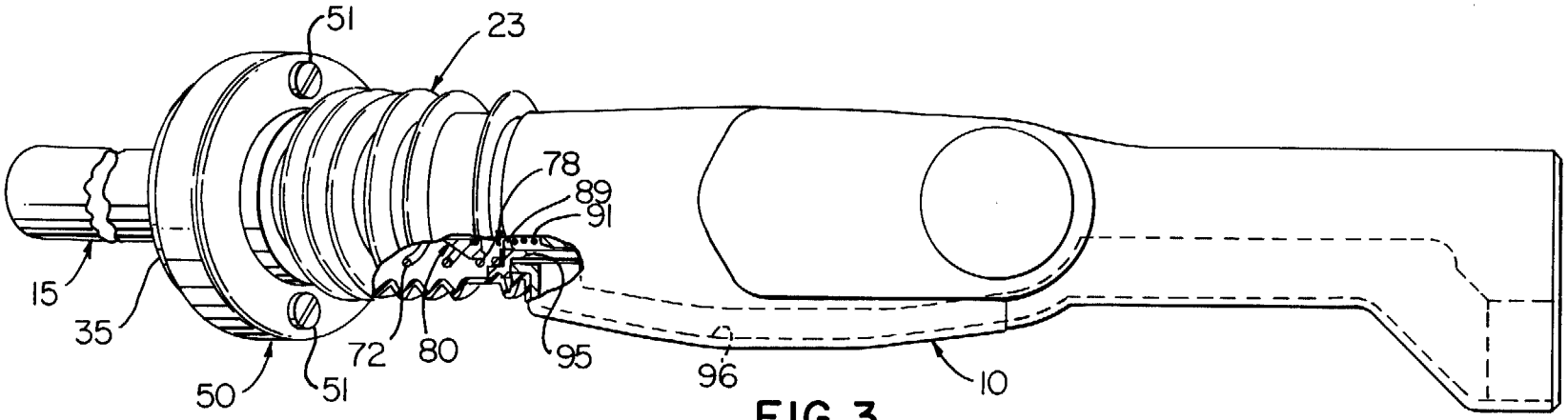
FIG. 3 is a fragmentary perspective view of a portion of the nozzle of FIG. 1.
Figure 5:
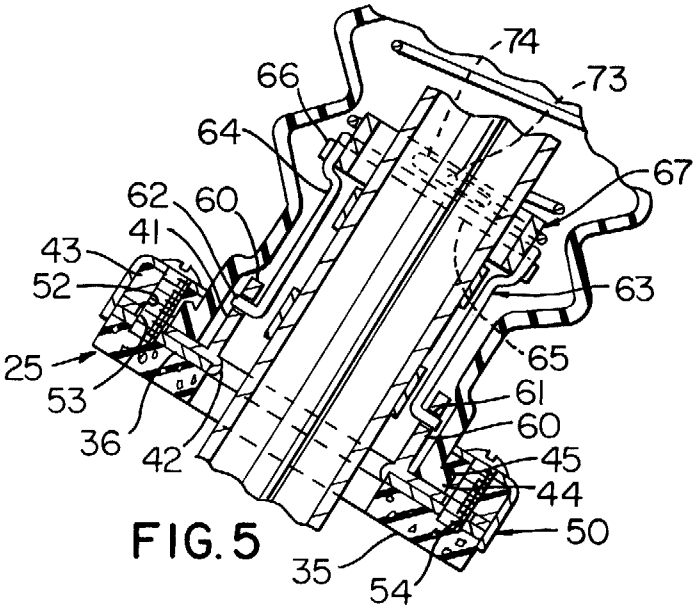
FIG. 5 is a fragmentary sectional view of the nozzle taken along line 5—5 of FIG. 1 and showing the connection of the relatively soft seal to the end of the bellows.

As shown in FIGS. 1 and 2, a cup-shaped cover 50 is disposed over the screws 46, the retaining ring 43, the outer surface of the base plate 40 of the retainer 41, the outer surface of the plate 36, and a portion of the outer surface of the member 35. The cover 50 has a pair of screws 51 (see FIGS. 3 and 5), which are diametrically disposed from each other and 90° from each of the screws 46, extending therethrough. The screws 51 also extend through non-threaded holes 52 in the retaining ring 43, non-threaded holes 53 in the base plate 40 of the retainer 41, and into threaded holes 54 (see FIGS. 4 and 5) in the annular plate 36 of the relatively soft sealing means 25.

Accordingly the screws 51 not only retain the cover 50 in position but also enable the relatively soft sealing means 25 to be removably fastened to the end of the bellows 23. Thus, whenever the member 35 wears, the relatively soft sealing means 25 can easily be replaced through removing the two screws 51 and positioning another of the relatively soft sealing means 25 adjacent the base plate 40 of the retainer 41.

The opening 26 in the relatively soft sealing means 25 provides communication to the annular passage 27 from the fill pipe 17 through an opening defined by the inner curved portion 42 of the retainer 41. Thus, as shown in FIG. 2, the member 35 engages the end of the fill pipe 17 to form a seal therebetween while providing communication to the annular passage 27 which functions as part of the vapor return passage to vapor recovery equipment (not shown).

The retainer 41 has a pair of diametrically disposed ears 60 (see FIGS. 1 and 5) extending upwardly from diametrically disposed portions of the annular base plate 40. Each of the ears 60 has an opening 61 formed therein to receive an end 62 of a wire connector 63. Each of the ends 62 of the wire connector 63 has a leg 64 extending therefrom with the legs 64, which are substantially parallel to the spout 15 and on opposite sides thereof, connected by a semicircular portion 65 (see FIGS. 5 and 6).

The semicircular portion 65 of the wire connector 63 is supported on an arcuate flange 66, which extends for a slightly less distance than the semicircular portion 65 as shown in FIG. 6, of a spring retainer 67. The retainer 67 is a hollow cylindrical body 68 having the arcuate flange 66 extending from one side thereof and a second arcuate flange 69 extending from the opposite side thereof. As shown in FIG. 6, the arcuate flange 69 extends a smaller angular amount than the arcuate flange 66. As shown in FIGS. 1 and 2, the flange 66 is closer to the relatively soft sealing means 25 than the flange 69.

The arcuate flange 69 supports a portion of a spring 72, which has its tab end 73 disposed in a slot 74 (see FIGS. 5 and 7) in the cylindrical body 68. The bottom of the slot 74 and the support surface of the flange 69 are in the same place. The cylindrical body 68 has a protrusion 75, which is diametrically disposed to the slot 74, extending therefrom to overlie a portion of the spring 72 to retain the overlying portion of the spring 72 between the protrusion 75 and the arcuate flange 69.

The spring 72 extends from the spring retainer 67 in surrounding relation to a portion of the spout 15. The spring 72 has its other tab end which is similar to the tab end 73 disposed in an opeaing (not shown) in a slidable cylindrical member 78, which is slidably supported within the outlet 14 of the body 10.

As shown in FIG. 7, the slot 74 in the spring retainer 67 extends for a substantially greater distance than the size of the tab end 73 of the spring 72. Thus, there can be relative rotation between the spring retainer 67 and the spout 15 since the cylindrical member 78 cannot rotate relative to the spout 15 and the other tab end of the spring 72 is fixed to the cylindrical member 78 while the slot 74 enables relative motion of the tab end 73 of the spring 72 with respect to the spring retainer 67. Accordingly, the spout 15 can rotate relative to the relatively soft sealing means 25 and the spring retainer 67, which has the relatively soft sealing means 25 pivotally connected thereto.

The slidable cylindrical member 78 is a portion of a check valve 79, which also includes a seat ring 80 on the spout 15. The check valve 79 is the invention of Jack Alan McMath and is more particularly shown and described in his copending application for "Liquid Dispensing Nozzle Having A Sealing Arrangement For Vapor Return Means," Ser. No. 696,937, filed June 17, 1976 now abandoned, and assigned to the same assignee as the assignee of this application.

Both the ring 80 and the slidable member 78 are concentric to the longitudinal axis of the portion of the spout 15 on which the ring 80 is mounted. The ring 80, which has its surface 82 inclined to provide more streamlined flow of the vapor within the annular passage 27 is secured to the spout 15 by suitable means such as a pair of set screws disposed 90° from each other, for example. The ring 80 has a groove in its inner surface to receive an O-ring 83 to form a seal with the outer surface of the spout 15 on which the ring 80 is mounted.

The ring 80 has an annular projection or shoulder 84 formed thereon adjacent its periphery for cooperation with an annular resilient disc 85, which is preferably formed of rubber and is fixed to an end face 86 of the slidable member 78 and retained thereon by the spring 72. The annular projection 84 on the ring 80 engages the resilient disc 85 intermediate its ends as shown in FIG. 1 to form a seal therebetween.

The resilient disc 85 is retaind in the slidable member 78 within a recess 87 (see FIG. 2), which is formed by an enlarged annular portion 88 on the slidable member 78. The portion 88 has the opening, which has the other tab end of the spring 72 disposed therein, formed therein. Thus, a portion of the spring 72 is disposed in the recess 87.

The inner surface of the annular resilient disc 85 terminates in alignment with the inner ends of three lugs 89, which are equally angularly spaced from each other, at the junction of the enlarged annular portion 88 and a hollow cylindrical portion 90 of the slidable member 78. The resilient disc 85 has its flat surface, which is engaged by the annular projection 84 of the ring 80, substantially perpendicular to the longitudinal axis of the portion of the spout 15 on which the ring 80 is mounted. Thus, when there is relative movement between the ring 80 and the slidable member 78, there is axial motion of the resilient disc 85 relative to the annular projection 84 of the ring 80 in the direction of the longitudinal axis of the portion of the spout 15 having the ring 80 mounted thereon.

A spring 91, which has one end acting against the lugs 89 on the slidable member 78 and its other end acting against a ring 92 of a guide 93, continuously urges the resilient disc 85 of the slidable member 78 against the annular projection 84 on the ring 80 to seal the annular passage 27 from communication with the vapor recovery equipment. The guide 93 is disposed in a longitudinal slot 94 in the slidable member 78 to prevent relative rotation of the slidable member 78 during its sliding motion relative to the body 10. As more particularly shown and described in the copending patent application of Jack Alan McMath for "Automatic Shut-Off Nozzle With Vapor Return Seal," Ser. No. 684,441, filed May 7, 1976, now abandoned, and assigned to the same assignee as the assignee of this application, the guide 93 has a forked end to fit over a portion of the spout adapter 18 so as to not rotate with respect thereto whereby relative rotation of the slidable member 78 with respect to the spout 15 is prevented.

In addition to having the longitudinal slot 94 formed in the hollow cylindrical portion 90 of the slidable member 78, the hollow cylindrical portion 90 has a longitudinal cut out portion 95 (see FIG. 3) formed therein with its centerline 90° from the centerline of the slot 94. The cut out portion 95, which extends for the length of the hollow cylindrical portion 90 of the slidable member 78, provides communication from the interior of the slidable member 78 to a vapor return passage 96 in the body 10. The vapor return passage 96 communicates through a hose 97 (see FIG. 1) with the vapor recovery equipment.

When the spout 15 has its free end inserted in the fill pipe opening 16 as shown in FIG. 2, the spring 72 is compressed. This causes the spring 91 to be overcome to move the slidable member 78 and the resilient disc 85 away from the annular projection 84 on the ring 80. This results in the annular passage 27 no longer being sealed by the resilient disc 85 engaging the annular projection 84 on the ring 80 so that vapor can flow from the vehicle tank, which is being filled, through its fill pipe 17, the opening 16 of the fill pipe 17, the opening 26 in the relatively soft sealing means 25, the annular passage 27, the cut out portion 95 in the slidable member 78, and the vapor return passage 96 in the body 10 to the vapor return hose 97.

Thus, the vapor recovery equipment, which is connected to the vapor return hose 97, communicates with the vehicle tank being filled to receive the vapor therefrom. However, it cannot communicate with the atmosphere because the resilient disc 85 moves away from the annular projection 84 on the ring 80 only after the spring 72 has been compressed sufficiently through disposing the free end of the spout 15 within the fill pipe opening 17 and holding it therein by the retaining lug 31 on one of the latch rings 28 and 29.

Vapor cannot flow between the bellows 23 and the portion 88 of the slidable member 78 because a portion 98 of the bellows 23 is disposed in a groove 99 in the portion 88 of the slidable member 78 and clamped thereto by a clamp 24a. The free end of the bellows 23 is retained against the body 10 by the clamp 24. As a result of clamping the bellows 23 by the clamp 24 and clamping the portion 98 to the slidable member 78 by the clamp 24a, a portion 100 of the bellows 23 flexes when the slidable member 78 is moved from the position of FIG. 1 to the position of FIG. 2 to enable vapor flow to occur from the annular passage 27 to the vapor return hose 97.

The slidable member 78 functions as an interlock sleeve to allow liquid flow through the body 10 only if the relatively soft sealing means 25 is in sealing engagement with the end of the fill pipe 17 when the spout 15 is inserted in the fill pipe opening 16 to supply the liquid thereto as more particularly shown and described in the aforesaid McMath application for "Automatic Shut-Off Nozzle With Vapor Return Seal." Thus, the slidable member 78 functions in the manner shown and described in the aforesaid McMath application for "Automatic Shut-Off Nozzle With Vapor Return Seal" to control liquid flow through the spout 15 and has the resilient disc 85 thereon to control vapor flow from the annular passage 27 to the vapor return hose 97 so that the vapor recovery equipment, which is connected to the vapor return hose 97, cannot communicate with the atmosphere at any time.

Considering the operation of the present invention, the free end of the spout 15 is inserted into the fill pipe opening 16. As the spout 15 is inserted into the fill pipe opening 16, the member 35 of the relatively soft sealing means 25 engages the end of the fill pipe 17 as shown in FIG. 2. As the spout 15 continues to be moved into the fill pipe opening 16, the bellows 23 and the spring 72 are compressed. This is because the bellows 23 is fixed to the body 10, which has the spout 15 connected thereto so that the body 10 is moving towards the fill pipe 17 while the end of the bellows 23 secured to the retainer 41 through the retaining ring 43 cannot move. Since the spring retainer 67 can only pivot about its connection through the wire connector 63 to the retainer 41, the spring retainer 67 also is prevented from moving with the spout 15 as the spout 15 moves into the fill pipe opening 16. As the spout 15 is advanced into the fill pipe 17 after the spring 72 has been compressed to load the relatively soft sealing means 25, the spring 91 is overcome so that the resilient disc 85 on the slidable member 78 is moved away from the annular projection 84 on the ring 80, which is mounted on the spout 15. When this occurs, vapor flow can occur from the annular passage 27 to the vapor return hose 97. Further insertion of the spout 15 into the fill pipe is accommodated by additional compression of the spring 72. This is to accommodate fill pipes of various construction.

The total motion of the slidable member 78 relative to the ring 80 and the nozzle body 10 is limited by a face 101 of the slidable member 78 engaging front end 102 of the body 10. Thus, there is a maximum compression of the spring 91.

When flow through the spout 15 is stopped, either automatically or manually as discussed in the aforesaid McMath application for "Automatic Shut-Off Nozzle with Vapor Return Seal," the spout 15 is removed from the fill pipe opening 16. During removal of the spout 15 from the fill pipe opening 16, the spring 72 starts to expand first.

When the spring 72 has expanded sufficiently so that the forces produced by the springs 72 and 91 are equal, the spring 91 begins to expand but at a different rate than that at which the spring 72 is still expanding. As a result, the springs 72 and 91 cooperate to cause the resilient disc 85 to be moved into engagement with the annular projection 84 on the ring 80 during the removal of the spout 15 from the fill pipe opening 16.

When the resilient disc 85 engages the annular projection 84 on the ring 80, the spring 72 has still not completed its expansion so that it is still exerting a force against the relatively soft sealing means 25 to cause the relatively soft sealing means 25 to be in sealing engagement with the fill pipe 17. Therefore, the check valve 79 is closed before the relatively soft sealing means 25 ceases to have sealing engagement with the fill pipe 17. This insures that communication between the annular passage 27 and the vapor return hose 97 is blocked before the relatively soft sealing means 25 ceases to have sealing engagement with the fill pipe 17.

Figure 9:
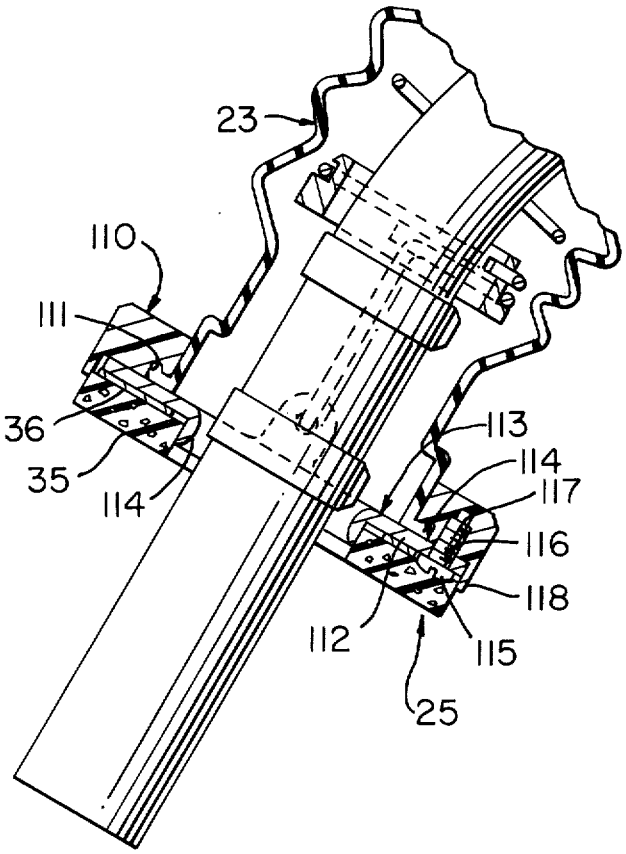
FIG. 9 is a fragmentary sectional view of the nozzle of FIG. 1 with another arrangement for removably fastening the bellows and the relatively soft seal.
Figure 11:
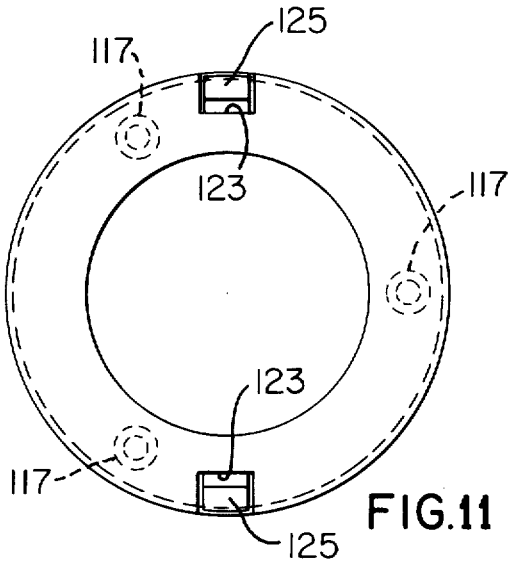
FIG. 11 is a top plan view of the bellows retaining ring of FIGS. 9 and 10.
Figure 10:
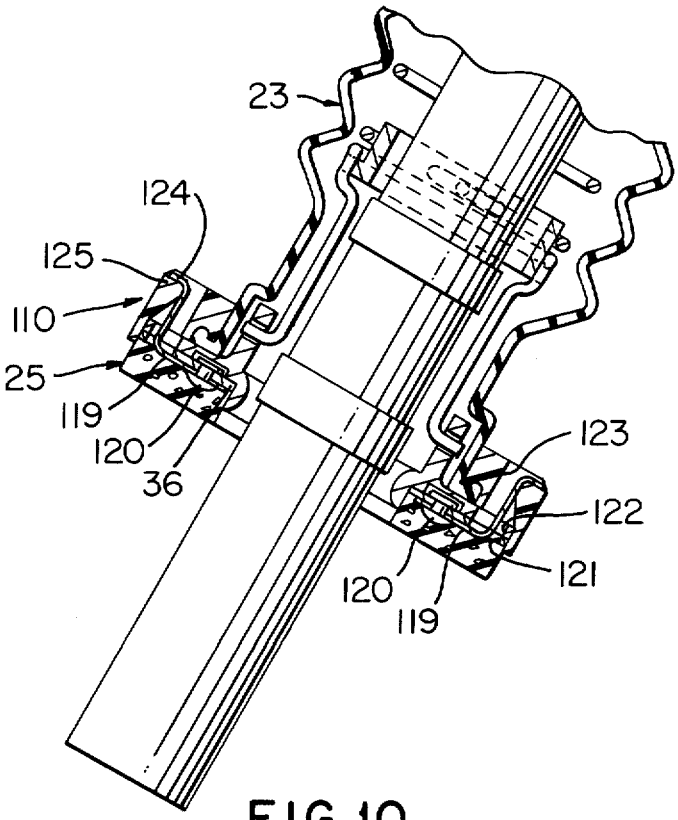
FIG. 10 is a fragmentary sectional view of the nozzle of FIG. 9 taken at a right angle to FIG. 9 and showing the connection of the relatively soft seal to the end of the bellows.

While the removable fastening means for securing the relatively soft sealing means 25 to the end of the bellows 23 has employed the screws 51, it should be understood that any other suitable arrangement could be employed to removably connect the relatively soft sealing means 25 and the end of the bellows 23. Referring to FIGS. 9–11, there is shown another removable fastening arrangement wherein a bellows retaining ring 110 is used in place of the retaining ring 43. The retaining ring 110 has a recess 111 therein to receive the enlarged end 44 of the bellows 23. The enlarged end 44 of the bellows 23 is retained between the retaining ring 110 and an annular base plate 112 of a retainer 113, which is employed in place of the retainer 41. The only difference between the retainer 113 and the retainer 41 is that the retainer 113 has a curved inner portion 114 overlapping a portion of the inner surface of the member 35 of the relatively soft sealing means 25 while the inner curved portion 42 of the retainer 41 does not overlap a portion of the inner surface of the member 35 of the relatively soft sealing means 25.

The retainer 113 and the retaining ring 110 are secured to each other by a plurality of screws 115, which extend through non-threaded holes 116 in the base plate 112 of the retainer 113 and into threaded holes 117 in the retaining ring 110. As shown in FIG. 11, the retaining ring 110 has three of the threaded holes 117, which are equally angularly spaced from each other.

As shown in FIGS. 9 and 10, the retaining ring 110 has an annular portion 118 as its end. The annular portion 118 extends over a portion of the outer surface of the member 35 of the relatively soft sealing means 25. Thus, with the retaining ring 110 having the annular portion 118, the cover 50 of FIG. 1 is not required. It should be understood that the cover 50 and the retaining ring 43 of FIG. 1 could be replaced by the retaining ring 110 with the annular portion 118, if desired. Of course, there would only be two of the screws 46 and two of the screws 51 in the same manner as described for FIG. 1 rather than three of the screws as shown in FIGS. 9–11.

The relatively soft sealing means 25 has a pair of spring clips 119 (see FIG. 10), which are diametrically disposed to each other and secured by rivets 120 to the plate 36 of the relatively soft sealing means 25. Each of the spring clips 119 extends through a passage 121 in the plate 36 of the relatively soft sealing means 25, a passage 122 in the base plate 112 of the retainer 113, and a passage 123 in the retaining ring 110. Each of the spring clips 119 has a portion 124 overlying a shoulder 125 in the retaining ring 110 and adjacent to the passage 123 to connect to the retaining ring 110.

Accordingly, the spring clips 119 enable the relatively soft sealing means 25 to be removably fastened to the retaining ring 110 with the retaining ring 110 being removably connected to the end of the bellows 23. Thus, whenever the member 35 wears, the relatively soft sealing means 25 can be easily replace.

Figure 12:
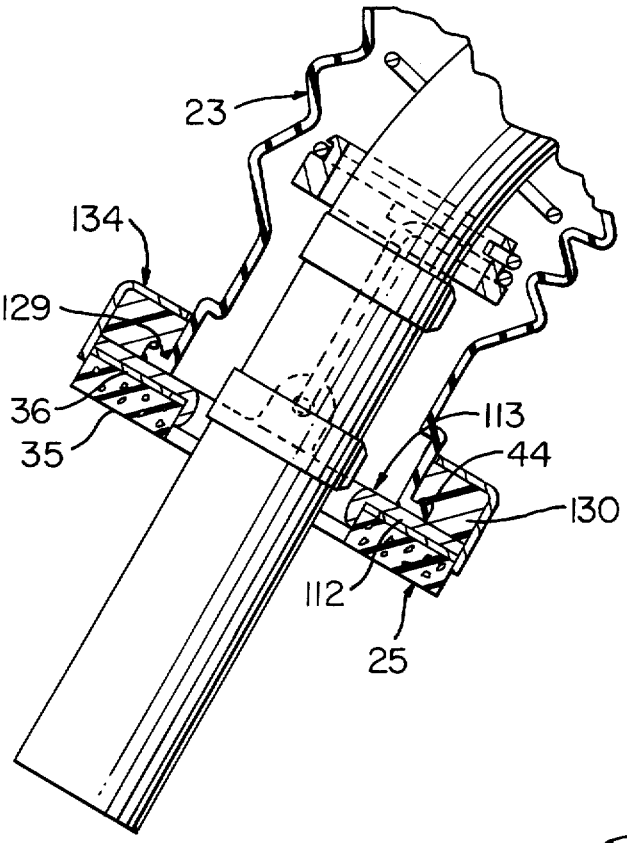
FIG. 12 is a fragmentary sectional view of the nozzle of FIG. 1 having a further arrangement for removably fastening the bellows and the relatively soft seal.
Figure 13:
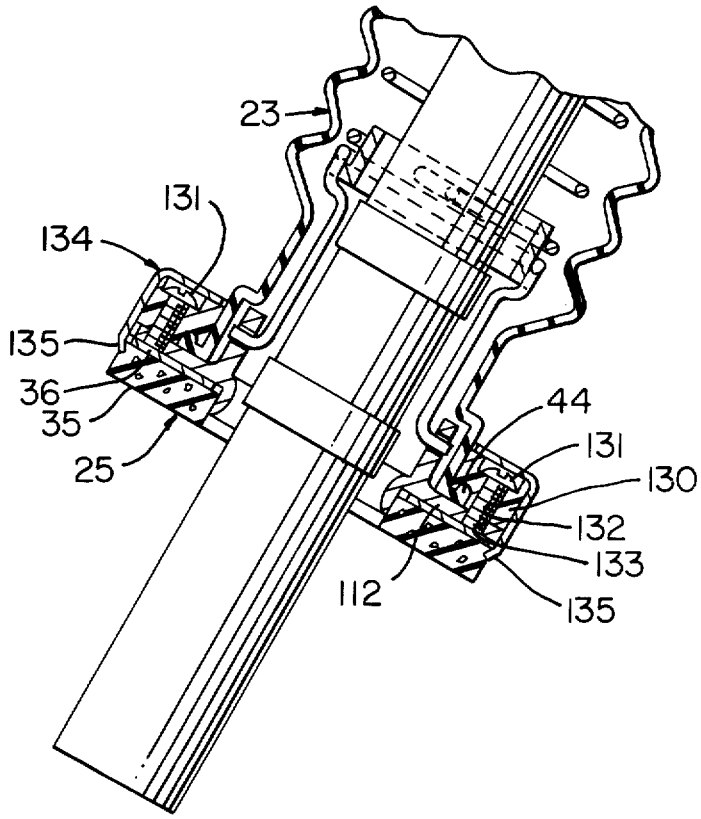
FIG. 13 is a fragmentary sectional view of the nozzle of FIG. 12 taken at a right angle to FIG. 12 and showing the connection of the relatively soft seal to the end of the bellows.

Referring to FIGS. 12 and 13, there is shown another form of the removable fastening means between the bellows 23 and the relatively soft sealing means 25. In this modification, the bellows 23 has its enlarged end 44 disposed in a recess 129 in a retaining ring 130 and retained between the retaining ring 130 and the base plate 112 of the retainer 113. The retaining ring 130 is secured to the base plate 112 through screws 131 extending through non-threaded holes 132 in the retaining ring 130 and into threaded holes 133 in the base plate 112 of the retainer 113.

As shown in FIG. 13, a cup-shaped cover 134 is disposed over the screws 131, the retaining ring 130, the outer surface of the base plate 112 of the retainer 113, the outer surface of the plate 36, and a portion of the outer surface of the member 35. The cover 134 has a plurality of tabs 135 formed at its end for crimping into the member 35 to removably fasten the relatively soft sealing means 25 to the retaining ring 130 and the retainer 113. The cover 134 preferably has three of the tabs 135, which are equally angularly spaced about the circumference of the cover 134.

Accordingly, when it is desired to replace the relatively soft sealing means 25 of FIGS. 12 and 13, it is only necessary to remove the tabs 135 from the member 35 of the relatively soft sealing means 25. Then, another of the relatively soft sealing means 25 can be disposed against the base plate 112 of the retainer 113 and connected thereto by the tabs 135 again being bent or crimped into the member 35 of the relatively soft sealing means 25.

Figure 14:
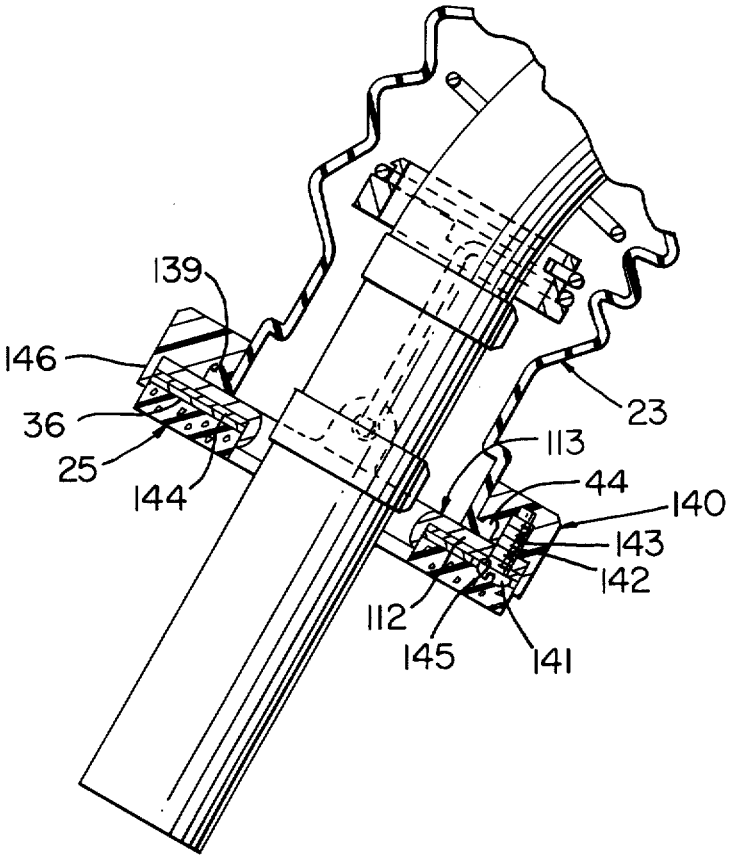
FIG. 14 is a fragmentary sectional view of the nozzle of FIG. 1 and showing still another arrangement for removably fastening the bellows and the relatively soft seal.
Figure 15:
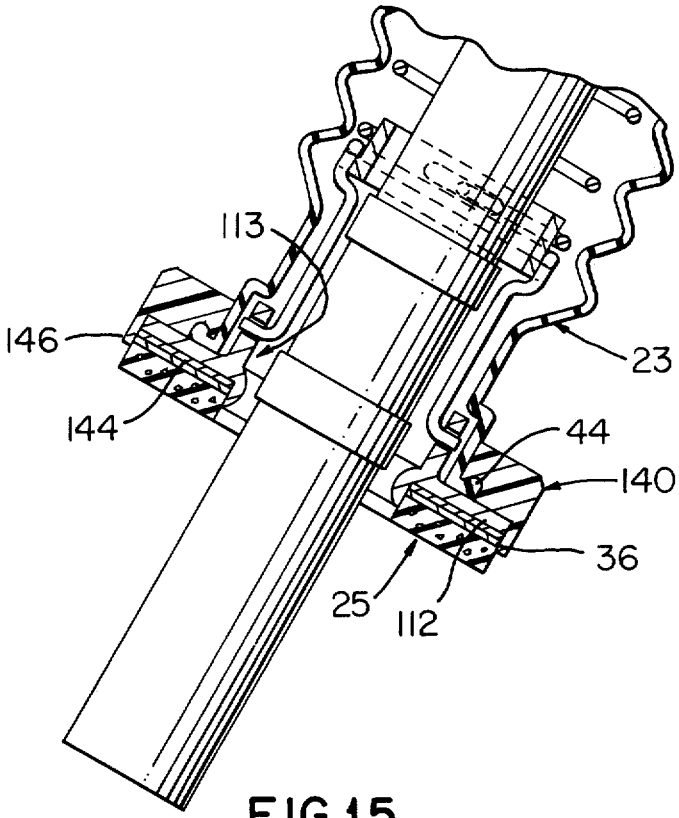
FIG. 15 is a fragmentary sectional view of the nozzle of FIG. 14 taken at a right angle to FIG. 14 and showing the connection of the relatively soft seal to the end of the bellows.

Referring to FIGS. 14 and 15, the enlarged end 44 of the bellows 23 is retained in a recess 139 in a retaining ring 140 between the retaining ring 140 and the base plate 112 of the retainer 113. The retaining ring 140 has the retainer 113 secured thereto by a plurality of screws 141, which extend through non-threaded holes 142 in the base plate 112 of the retainer 113 and into threaded holes 143 in the retaining ring 140. There are preferably three of the screws 141 with the screws 141 equally angularly spaced from each other.

A plate 144 of magnetic material is secured to the base plate 112 by the screws 141 extending through non-threaded holes 145 in the plate 144. With the plate 36 of the relatively soft sealing means 25 formed of metal, the relatively soft sealing means 25 will be removably fastened to the retainer 112 by the magnetic attraction of the plate 36 to the plate 144.

Accordingly, the relatively soft sealing means 25 can be easily removed from the retainer 113 by exerting a sufficient force on the relatively soft sealing means 25 to overcome the magnetic attraction between the metallic plate 36 and the magnetic plate 144. It should be understood that the retaining ring 140 has an annular projection 146 on its end for overlapping in the same manner as the annular projection 118 on the retaining ring 110 of FIGS. 9 and 10 overlaps whereby the cover 50 is not needed.

Figure 16:
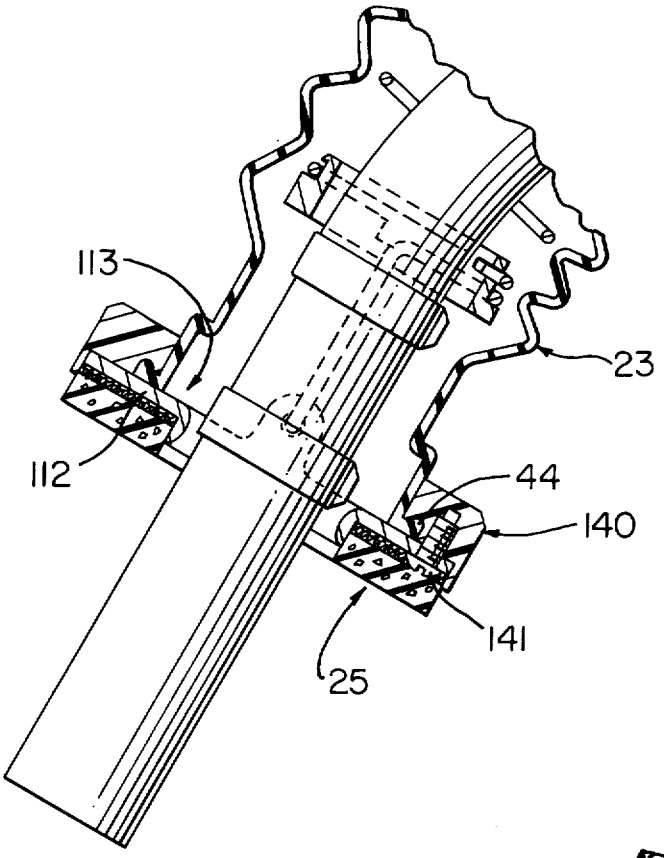
FIG. 16 is a fragmentary sectional view of the nozzle of FIG. 1 and showing a still further arrangement for removably fastening the bellows and the relatively soft seal.
Figure 17:
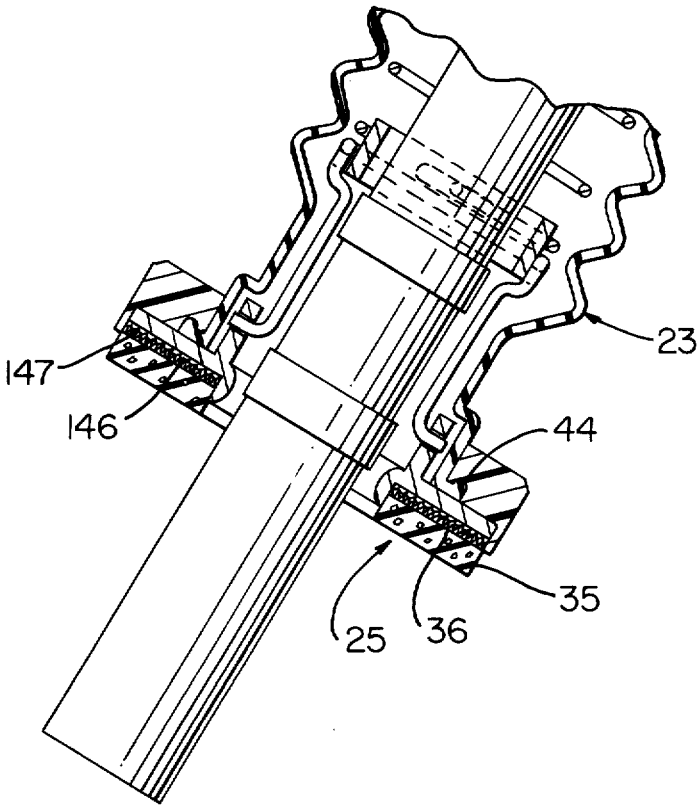
FIG. 17 is a fragmentary sectional view of the nozzle of FIG. 16 taken at a right angle to FIG. 16 and showing the connection of the relatively soft seal to the end of the bellows.

Referring to FIGS. 16 and 17, there is shown another arrangement for removably fastening the enlarged end 44 of the bellows 23 to the relatively soft sealing means 25. This embodiment uses the retaining ring 140 and the screws 141 of FIGS. 14 and 15 to connect the base plate 112 of the retainer 113 to the retaining ring 140.

The base plate 112 has a hook material 146 (see FIG. 17) secured thereto by an adhesive. A loop material 147 is bonded to the relatively soft sealing means 25 to releasably fasten the relatively soft sealing means 25 to the bellows 23. A suitable hook and loop material is manufactured by Velcro Corporation of New York, N.Y.

Figure 18:
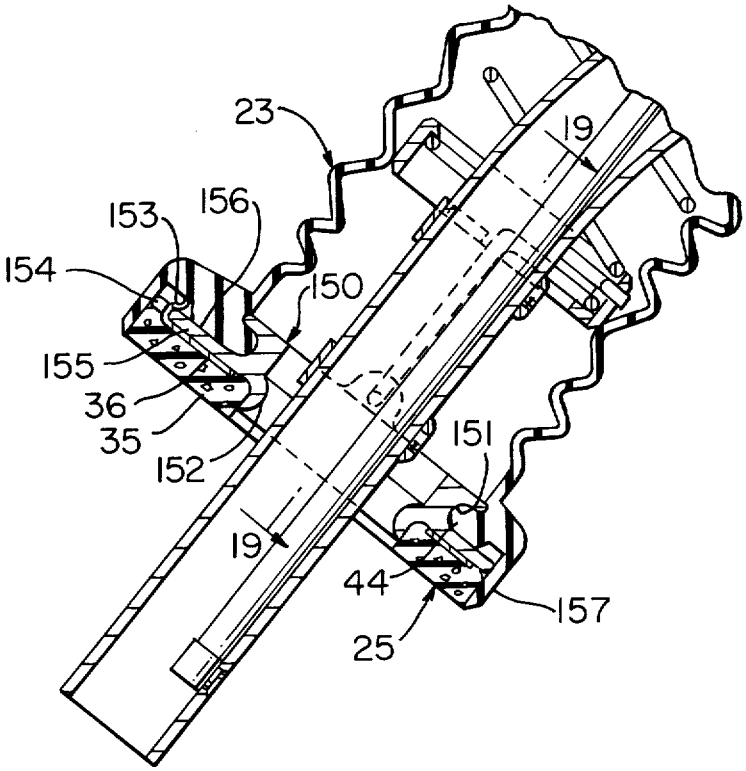
FIG. 18 is a fragmentary sectional view of the nozzle of FIG. 1 and showing a still further arrangement for removably fastening the bellows and the relatively soft seal.
Figure 19:
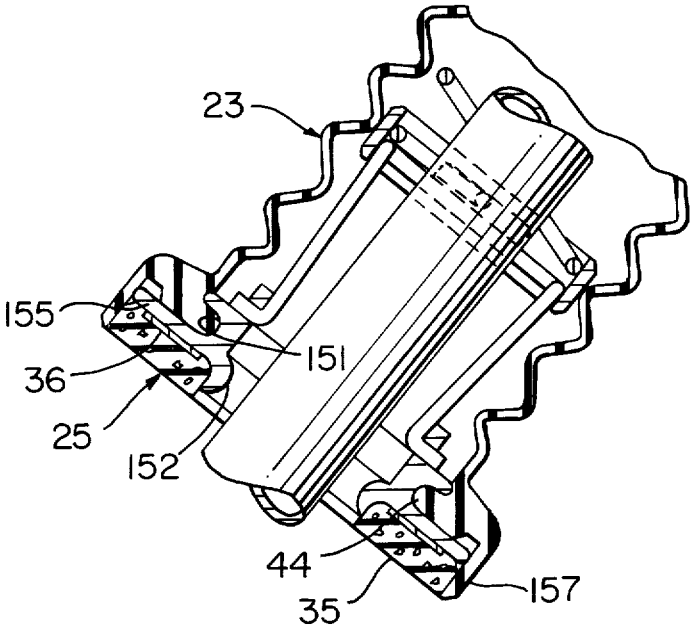
FIG. 19 is a fragmentary sectional view of the nozzle of FIG. 18 taken at a right angle to FIG. 18 along line 19—19 of FIG. 18 and showing the connection of the relatively soft seal to the end of the bellows.

Referring to FIGS. 18 and 19, there is shown another arrangement for removably fastening the enlarged end 44 of the bellows 23 to the relatively soft sealing means 25. This embodiment utilizes a retaining ring 150 to receive the enlarged end 44 of the bellows 23 and to have the relatively soft sealing means 25 releasably connected thereto. The retaining ring 150 has a recess 151 formed therein to receive the enlarged end 44 of the bellows 23 so that the bellows 23 is removably fastened to the retaining ring 150. The retaining ring 150 has an inner curved portion 152 overlapping a portion of the inner surface of the member 35 of the relatively soft sealing means 25.

As shown in FIGS. 18 and 19, the plate 36 of the relatively soft sealing means 25 does not extend to either the inner or outer edge of the member 35 of the relatively soft sealing means 25. The outer edge of the plate 36 has three hooks or clips 153 formed integral therewith and equally angularly spaced from each other.

Each of the hooks or clips 153 has a first portion extending substantially perpendicular from the plate 35 and a second portion bent inwardly from the first portion. Each of the hooks or clips 153 extends through a slot 154 formed in the outer edge of an annular projection 155 of the retaining ring 150. Thus, the hooks or clips 153 are releasably fastened to the retaining ring 150 through having the second portion of each of the hooks or clips 153 engage a flat surface 156 of the annular projection 155 adjacent the slot 154.

In this modification, the bellows 23 has an annular portion 157 overlying the outer edge of the member 35 of the relatively soft sealing means 25 and the outer edge of the annular projection 155 of the retaining ring 150. Thus, the annular portion 157 of the bellows 23 functions as a dust seal so that the cover 50 of FIG. 1 is not required.

While the present invention has shown and described the resilient disc 85 as being mounted on the slidable member 78, it should be understood that the ring 80 could have the resilient sealing disc 85 formed thereon. In this arrangement, the annular projection 84 would be removed from the ring 80 and an annular projection formed on the slidable member 78.

While the present invention has been shown and described as being utilized with the check valve 79 of the aforesaid McMath application for "Liquid Dispensing Nozzle Having A Sealing Arrangement For Vapor Return Means," it should be understood that any suiable type of check valve could be employed. While the present invention has shown and described the relatively soft sealing means 25 being utilized in conjunction with the check valve 72, it should be understood that a check valve is not necessary for satisfactory operation of the relatively soft sealing means 25.

While the present invention has been shown and described as being employed with the slidable member 78, it should be understood that the slidable member 78 could be omitted when the check valve 79 is not utilized. In this arrangement, it would be necessary to secure the other tab end of the spring 72 to a portion of the body 10.

An advantage of this invention is that a vapor recovery seal is provided around any fill pipe irrespective of its angle. Another advantage of this invention is that the vapor recovery seal may be easily replaced. A further advantage of this invention is that the spout may be retained within the fill pipe opening irrespective of the angle of the fill pipe.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. A liquid dispensing nozzle comprising a body, a spout extending from said body and having its free end for disposition in an opening of a fill pipe of a tank or the like, means to return vapor from the tank being filled, sealing means to form a seal between the fill pipe opening and said vapor return means when said spout is disposed in the fill pipe, said sealing means including a member formed solely of a relatively soft, non-fluid material compressible when engaging the fill pipe, said member having a pair of substantially parallel surfaces with one of said pair of surfaces engaging the fill pipe, at least one of said sealing means and said vapor return means including rigid backing means for rigidly supporting said mer ıber of relatively soft, non-fluid material and disposed adjacent the other of said pair of surfaces of said member, means to continuously urge said sealing means toward the free end of said spout, said sealing means including means to provide communication from the tank being filled to said vapor return means when said member of relatively soft, non-fluid material of said sealing means is in sealing engagement with the fill pipe, and means to removably fasten said sealing means to said vapor return means with said member of relatively soft, non-fluid material being rigidly supported by said rigid backing means when said member of relatively soft, non-fluid material engages the fill pipe.

2. The nozzle according to claim 1 including first and second retaining means positioned on said spout at selected locations in spaced relation to each other, each of said first and second retaining means including a latch ring secured to said spout, each of said latch rings including an eccentric lug positioned adjacent the bottom of said spout, each of said eccentric lugs having an inclined surface to engage the fill pipe to retain said spout within the fill pipe without preventing removal of said spout from the fill pipe when desired, and said inclined surface of said eccentric lug of said latch ring of one of said first retaining means and said second retaining means engaging the fill pipe to retain said spout within the fill pipe.

3. A liquid dispensing nozzle comprising a body, a spout extending from said body and having its free end for disposition in an opening of a fill pipe of a tank or the like, means to return vapor from the tank being filled, sealing means to form a seal between the fill pipe opening and said vapor return means when said spout is disposed in the fill pipe, said sealing means including a member formed solely of a relatively soft, non-fluid material compressible when engaging the fill pipe, said member having a pair of substantially parallel surfaces with one of said pair of surfaces engaging the fill pipe, at least one of said sealing means and said vapor return means including rigid backing means for rigidly supporting said member of relatively soft, non-fluid material and disposed adjacent the other of said pair of surfaces of said member, means to continuously urge said sealing means toward the free end of said spout, said sealing means including means to provide communication from the tank being filled to said vapor return means when said member of relatively soft, non-fluid material of said sealing means is in sealing engagement with the fill pipe, means to removably fasten said sealing means to said vapor return means with said member of relatively soft, non-fluid material being rigidly supported by said rigid backing means when said member of relatively soft, non-fluid material engages the fill pipe, said vapor return means including compressible means disposed in spaced relation to said spout to form an annular passage therebetween, one end of said compressible means being secured to said body, and said removably fastening means fastening said sealing means to the other end of said compressible means.

4. The nozzle according to claim 3 in which said compressible means includes a bellows having one end connected to said body and its other end removably fastened to said sealing means by said removably fastening means.

5. The nozzle according to claim 4 including first and second retaining means positioned on said spout at selected locations in spaced relation to each other, each of said first and second retaining means including a latch ring secured to said spout, each of said latch rings including an eccentric lug, each of said eccentric lugs having an inclined surface to engage the fill pipe to retain said spout within the fill pipe, and said inclined surface of said eccentric lug of said latch ring of one of said first retaining means and said second retaining means engaging the fill pipe to retain said spout within the fill pipe.

6. The nozzle according to claim 5 in which said communication means of said sealing means comprises a circular passage extending through said sealing means to receive said spout and form an annular passage therearound to communicate with said annular passage.

7. The nozzle according to claim 6 in which said urging means includes resilient means disposed in surrounding relation to said spout and having one end connected so as to not have relative rotation with respect to said spout, means surrounding said spout and having the other end of said resilient means connected thereto for relative motion therebetween about the longitudinal axis of said spout, said surrounding means being disposed in spaced relation to said sealing means, and means to pivotally connect said surrounding means to said sealing means to allow rotation of said spout relative to said sealing means and to have said resilient means exert a force through said surrounding means and said pivotally connecting means to continuously urge said sealing means toward the free end of said spout.

8. The nozzle according to claim 7 in which said resilient means comprises a spring having one end connected to said body so as not to have relative rotation with respect to said spout, said surrounding means having an opening to receive the other end of said spring to connect said spring thereto, said opening of said surrounding means being larger than the other end of said spring to allow relative motion therebetween, and said pivotally connecting means includes guide means to overlie the inner surface of said sealing means for at least a portion of the length of said sealing means to guide said eccentric lug of each of said latch rings during movement therethrough.

9. The nozzle according to claim 4 in which said communication means of said sealing means comprises a circular passage extending through said sealing means to receive said spout and form an annular passage therearound to communicate with said annular passage.

10. The nozzle according to claim 3 including means connected to the other end of said compressible means, said removably fastening means including first means formed integral with said member of relatively soft non-fluid material and second means carried by said connected means and removably connected to said first means to removably connect said sealing means to said connected means, and said rigid backing means including at least one of said first and second means of said removably fastening means.

11. The nozzle according to claim 10 in which said sealing means includes a substantially rigid annular support plate integral with said member of relatively soft, non-fluid material, said second means of said removably fastening means includes screw means, said first means of said removably fastening means includes said plate having threaded holes to receive said screw means, said rigid backing means includes said plate, and said screw means is disposed in said threaded holes to connect said sealing means to said connected means.

12. The nozzle according to claim 10 in which one of said first and second means of said removably fastening means includes spring clips secured to one of said sealing means and said connected means and the other of said first and second means of said removably fastening means includes the other of said sealing means and said connected means having means to receive said spring clips.

13. The nozzle according to claim 10 in which said first means of said removably fastening means includes spring clips secured to said sealing means and said second means of said removably fastening means includes said connected means having means to receive said spring clips.

14. The nozzle according to claim 10 in which said second means of said removably fastening means includes magnetic means supported on said connected means and said first means of said removably fastening means includes a plate integral with said member of relatively soft non-fluid material of said sealing means and having magnetic attraction to said magnetic means.

15. The nozzle according to claim 10 in which one of said first and second means of said removably fastening means includes hook means secured to one of said connected means and said sealing means and the other of said first and second means of said removably fastening means includes loop means secured to the other of said connected means and said sealing means for cooperation with said hook means to connect said sealing means to said connected means.

16. The nozzle according to claim 10 in which one of said first and second means of said removably fastening means includes means secured to one of said sealing means and said connected means and the other of said first and second means of said removably fastening means includes the other of said sealing means and said connected means having means to receive said secured means.

17. The nozzle according to claim 16 in which said secured means includes a plurality of equally angularly spaced hooks secured to said member of relatively soft non-fluid material of said sealing means to form said first means of said removably fastening means and said receiving means comprises equally angularly spaced means in said connected means to form said second means of said removably fastening means with each of said equally angularly spaced means receiving one of said equally angularly spaced hooks.

18. The nozzle according to claim 10 in which said first means of said removably fastening means includes means secured to said member of relatively soft non-fluid material of said sealing means and said second means of said removably fastening means includes said connected means having means to receive said secured means.

19. The nozzle according to claim 3 including means connected to the other end of said compressible means, a cover fitting over said connected means, and said removably fastening means including crimping means on said cover to hold said sealing means against said connected means.

20. A liquid dispensing nozzle comprising a body, a spout extending from said body and having its free end for disposition in an opening of a fill pipe of a tank or the like, means to return vapor from the tank being filled, sealing means to form a seal between the fill pipe opening and said vapor return means when said spout is disposed in the fill pipe, said sealing means being connected to said vapor return means, resilient means disposed in surrounding relation to said spout and having one end connected so as to not have relative rotation with respect to said spout, means surrounding said spout and having the other end of said resilient means connected thereto for relative motion therebetween about the longitudinal axis of said spout while preventing separation of said surrounding means from said resilient means, said surrounding means being disposed in spaced relation to said sealing means, and means to pivotally connect said surrounding means to said sealing means to allow rotation of said spout relative to said sealing means, to have said resilient means exert a force through said surrounding means and said pivotally connecting means to continuously urge said sealing means towards the free end of said spout, and to prevent separation of said sealing means from said surrounding means.

21. The nozzle according to claim 20 in which said resilient means has the one end connected to said body to limit the maximum movement of said sealing means towards the free end of said spout by said resilient means.

22. A liquid dispensing nozzle comprising a body, a spout extending from said body and having its free end for disposition in an opening of a fill pipe of a tank or the like, means to return vapor from the tank being filled, sealing means to form a seal between the fill pipe opening and said vapor return means when said spout is disposed in the fill pipe, said sealing means being connected to said vapor return means, resilient means disposed in surrounding relation to said spout and having one end connected so as to not have relative rotation with respect to said spout, means surrounding said spout and having the other end of said resilient means connected thereto for relative motion therebetween about the longitudinal axis of said spout, said surrounding means being disposed in spaced relation to said sealing means, means to pivotally connect said surrounding means to said sealing means to allow rotation of said spout relative to said sealing means and to have said resilient means exert a force through said surrounding means and said pivotally connecting means to continuously urge said sealing means toward the free end of said spout, said resilient means comprising a spring having one end connected to said body so as not to have relative rotation with respect to said spout, said surrounding means having an opening to receive the other end of said spring to connect said spring thereto, said opening in said surrounding means being larger than the other end of said spring to allow relative motion therebetween while limiting the total relative motion therebetween, and said opening in said surrounding means being disposed to not have said spout pass therethrough.

23. The nozzle according to claim 22 in which the other end of said spring extends through said opening in said surrounding means to connect said spring to said surrounding means.

24. The nozzle according to claim 22 in which said spring has a portion disposed on the exterior of said surrounding means in surrounding relation thereto and the other end of said spring extends through said opening in said surrounding means from the exterior of said surrounding means to connect said spring to said surrounding means.

25. A liquid dispensing nozzle comprising a body, a spout extending from said body and having its free end for disposition in an opening of a fill pipe of a tank or the like, means to return vapor from the tank being filled, sealing means to form a seal between the fill pipe opening and said vapor return means when said spout is disposed in the fill pipe, said sealing means including a member of a relatively soft, non-fluid material compressible when engaging the fill pipe, at least one of said sealing means and said vapor return means including rigid backing means for rigidly supporting said member of relatively soft, non-fluid material, means to continuously urge said sealing means toward the free end of said spout, said sealing means including means to provide communication from the tank being filled to said vapor return means when said member of relatively soft, non-fluid material of said sealing means is in sealing engagement with the fill pipe, means to removably fasten said sealing means to said vapor return means with said member of relatively soft, non-fluid material being rigidly supported by said rigid backing means when said member of relatively soft, non-fluid material engages the fill pipe, said vapor return means including compressible means disposed in spaced relation to said spout to form an annular passage therebetween, one end of said compressible means being secured to said body, and said removably fastening means fastening said sealing means to the other end of said compressible means.

26. A liquid dispensing nozzle comprising a body, a spout extending from said body and having its free end for disposition in an opening of a fill pipe of a tank or the like, means to return vapor from the tank being filled, sealing means to form a seal between the fill pipe opening and said vapor return means when said spout is disposed in the fill pipe, said sealing means including a member of a relatively soft, non-fluid material compressible when engaging the fill pipe, at least one of said sealing means and said vapor return means including rigid backing means for rigidly supporting said member of relatively soft, nonfluid material, means to continuously urge said sealing means toward the free end of said spout, said sealing means including means to provide communication from the tank being filled to said vapor return means when said member of relatively soft, non-fluid material of said sealing means is in sealing engagement with the fill pipe, means to removably fasten said sealing means to said vapor return means with said member of relatively soft, non-fluid material being rigidly supported by said rigid backing means when said member of relatively soft, non-fluid material engages the fill pipe, said urging means including resilient means disposed in surrounding relation to said spout and having one end connected so as to not have relative rotation with respect to said spout, means surrounding said spout and having the other end of said resilient means connected thereto for relative motion therebetween about the longitudinal axis of said spout, said surrounding means being disposed in spaced relation to said sealing means, and means to pivotally connect said surrounding means to said sealing means to allow rotation of said spout relative to said sealing means and to have said resilient means exert a force through said surrounding means and said pivotally connecting means to continuously urge said sealing means toward the free end of said spout.

27. The nozzle according to claim 26 in which said resilient means comprises a spring having one end connected to said body so as not to have relative rotation with respect to said spout, said surrounding means has an opening to receive the other end of said spring to connect said spring thereto, and said opening of said surrounding means is larger than the other end of said spring to allow relative motion therebetween while limiting the total relative motion therebetween.

* * * * *